US010254094B1

(12) United States Patent
Harrison

(10) Patent No.: US 10,254,094 B1
(45) Date of Patent: Apr. 9, 2019

(54) AIRCRAFT SHROUD SYSTEM

(71) Applicant: Richard A. Harrison, Los Angeles, CA (US)

(72) Inventor: Richard A. Harrison, Los Angeles, CA (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 166 days.

(21) Appl. No.: 15/282,376

(22) Filed: Sep. 30, 2016

Related U.S. Application Data

(60) Provisional application No. 62/255,809, filed on Nov. 16, 2015.

(51) Int. Cl.
*F42B 10/46* (2006.01)
*F42B 10/00* (2006.01)

(52) U.S. Cl.
CPC ..... *F42B 10/46* (2013.01)

(58) Field of Classification Search
CPC . F42B 10/46; F42B 15/36; B64C 7/00; B64G 1/002
USPC ..... 244/119, 121, 130
See application file for complete search history.

(56) References Cited

U.S. PATENT DOCUMENTS 3,377,952 A 4/1968 Crockett
3,706,281 A * 12/1972 Hatakeyama ..... F42B 15/36 102/378
3,754,507 A 8/1973 Dillinger et al.
4,930,731 A * 6/1990 Roy ..... F42B 10/46 102/293
4,964,339 A 10/1990 Bastian et al.
5,235,128 A * 8/1993 Hardesty ..... F42B 10/46 102/351
6,086,020 A * 7/2000 Machiussi ..... B64G 1/002 244/173.1
6,224,020 B1 * 5/2001 Hopkins ..... B64G 1/002 244/173.1
6,494,140 B1 12/2002 Webster
(Continued)

OTHER PUBLICATIONS

"Proton Launch System Mission Planner's Guide"; LKEB-9812-1990; Revision 7; Section 4, Spacecraft Interfaces; International Launch Services; Reston, Virginia, USA; Jul. 2009; no author given. (Year: 2009).*

(Continued)

*Primary Examiner* — Bernarr E Gregory
(74) *Attorney, Agent, or Firm* — Tarolli, Sundheim, Covell & Tummino LLP

(57) ABSTRACT

One example embodiment includes an aircraft system. The system includes a body comprising a payload and a propulsion system. The propulsion system can be configured to enable launch of the aircraft system. The system also includes a shrouding system that substantially encloses at least a portion of the body in a shrouded state. The shrouding system includes a fairing portion and a sleeve portion that are arranged as detachably coupled with respect to each other and with respect to the at least a portion of the body. The fairing portion can separate from the sleeve portion in a deployed state and the body can become axially separated from the sleeve portion in the deployed state. The aircraft system can switch from the shrouding state to the deployed state during a detach stage of the launch of the aircraft system.

19 Claims, 4 Drawing Sheets

(56) References Cited

U.S. PATENT DOCUMENTS

| | | | | |
|---|---|---|---|---|
| 6,494,406 | B1 * | 12/2002 | Fukushima | B64G 1/002 244/173.3 |
| 6,647,889 | B1 | 11/2003 | Biserød | |
| 6,679,453 | B2 | 1/2004 | Steiner | |
| 6,817,568 | B2 | 11/2004 | Spate et al. | |
| 7,093,799 | B1 | 8/2006 | Dulat et al. | |
| 8,505,455 | B2 * | 8/2013 | Fisch | F42B 10/46 102/377 |
| 8,519,312 | B1 | 8/2013 | Merems | |
| 8,931,738 | B2 | 1/2015 | White et al. | |
| 2009/0314890 | A1 * | 12/2009 | Koehler | F42B 10/46 244/119 |

OTHER PUBLICATIONS

Angus Stevenson, editor, "Oxford Dictionary of English," third edition; Oxford University Press; New York, NY, USA; print publication and online date: 2010; entry for the word, "tubular"; eISBN 9780191727665. (Year: 2010).*

* cited by examiner

AIRCRAFT SHROUD SYSTEM

RELATED APPLICATIONS

This application claims priority from U.S. Provisional Patent Application Ser. No. 62/255,809, filed 16 Nov. 2015, which is incorporated herein in its entirety.

TECHNICAL FIELD

The present disclosure relates generally to aviation, and specifically to an aircraft shroud system.

BACKGROUND

For many decades, aircraft have been implemented for a variety of uses as means of transportation, reconnaissance, and warfare. Different types of aircraft have been historically implemented for different purposes and utilize different types of propulsion systems. Rockets and missiles typically implement engines/thrusters that provide significant thrust to be able to lift the aircraft without or with very little assistance from wings. As an example, rockets and missiles can often be launched to achieve a significant altitude for travel. Due to the lack of oxygen at greater altitudes, a rocket or missile can more efficiently consume fuel to extend a mission range, such as to achieve impact with a target that is far away (e.g., hundreds of miles). As it achieves certain high altitudes, such aircraft can employ a shroud that can protect the payload, as well as other control components (e.g., navigation and other electronic components), from damage that can result from weather conditions. For example, at very high speeds achieved during ascent, rain and dense clouds can damage and/or destroy exposed portions of the aircraft. Thus, the shroud can protect the aircraft from such weather conditions.

SUMMARY

One example embodiment includes an aircraft system. The system includes a body comprising a payload and a propulsion system. The propulsion system can be configured to enable launch of the aircraft system. The system also includes a shrouding system that substantially encloses at least a portion of the body in a shrouded state. The shrouding system includes a fairing portion and a sleeve portion that are arranged as detachably coupled with respect to each other and with respect to the at least a portion of the body. The fairing portion can separate from the sleeve portion in a deployed state and the body can become axially separated from the sleeve portion in the deployed state. The aircraft system can switch from the shrouding state to the deployed state during a detach stage of the launch of the aircraft system.

Another example includes a method for detaching a shroud system that substantially encloses at least a portion of a body of an aircraft system in a shrouded state. The method includes releasing a coupling between a first fairing element of a fairing portion of the shroud system and a second fairing element of the fairing portion of the shroud system. The method also includes rotating the first fairing element and the second fairing element of the fairing portion of the shroud system approximately equally from an axial length of the aircraft system via respective break-away hinges. The method also includes physically separating the first fairing element and the second fairing element of the fairing portion of the shroud system from a sleeve portion of the shroud system that substantially surrounds a portion of the body of the aircraft in response to rotation of the first fairing element and the second fairing element greater than a predetermined angle from the axial length of the aircraft system. The method further includes axially separating the portion of the body of the aircraft system from the sleeve portion to axially eject the portion of the body of the aircraft from the sleeve portion of the shroud system to detach the shroud system from the aircraft in a deployed state.

Another example includes an aircraft system. The system includes a body comprising a payload and a propulsion system, the propulsion system being configured to enable launch of the aircraft system. The system also includes a shrouding system that substantially encloses at least a portion of the body in a shrouded state. The shrouding system includes a fairing portion comprising a plurality of substantially equal sized fairing elements that are arranged in approximately equal angles about a cross-section with respect to a longitudinal axis of the aircraft system and which are configured to separate and detach from the shrouding system in a deployed state during a detach stage of the launch of the aircraft system. The shrouding system also includes a sleeve portion comprising a tubular portion that substantially surrounds the at least a portion of the body along a longitudinal axis of the aircraft system, the sleeve portion being arranged as detachably coupled with respect to the fairing portion and with respect to the at least a portion of the body. The body can become axially separated from the sleeve portion in the deployed state via the propulsion system during the detach stage of the launch of the aircraft system.

DETAILED DESCRIPTION

The present disclosure relates generally to aviation, and specifically to an aircraft shroud system. The associated aircraft, which can be configured as a rocket or a missile, can include a body that comprises a payload and a propulsion system (e.g., that includes a plurality of propulsion subsystems). The shroud system can be configured to substantially enclose at least a portion of the body and can include a fairing portion and a sleeve portion in a shrouded state. For example, the propulsion system can include an external portion and an internal portion with respect to the shroud system, such that the shroud system can be coupled to the external portion and can substantially enclose the internal portion. The fairing portion can be detachably coupled to the sleeve portion and can be configured to detach from the sleeve portion during a detach stage of a launch. The sleeve portion can be a tubular portion that effectively "sleeves" the body portion, and thus substantially surrounds at least a portion of the body with respect to a longitudinal axis of the aircraft.

As an example, the fairing portion can be arranged in a two fairing element "clamshell" configuration that substantially covers a front end of the aircraft, such that during the detach stage of the launch, the two fairing elements can be released from each other to rotationally pivot about break-away hinges, such that the two fairing elements can separate from the sleeve portion in response to rotating greater than a predetermined angle about the respective break-away hinges. Subsequent to the separation of the two fairing elements of the fairing portion of the shroud system, the portion of the body that is substantially surrounded by the sleeve portion can axially separate from the sleeve portion, such as via an internal portion of the propulsion system. Thus, the propulsion system can operate to axially eject the remaining portion of the body from the sleeve portion to completely detach the shroud portion, such as at an altitude above which atmospheric factors can substantially no longer affect the integrity of the aircraft, in a deployed state.

Figure 1:
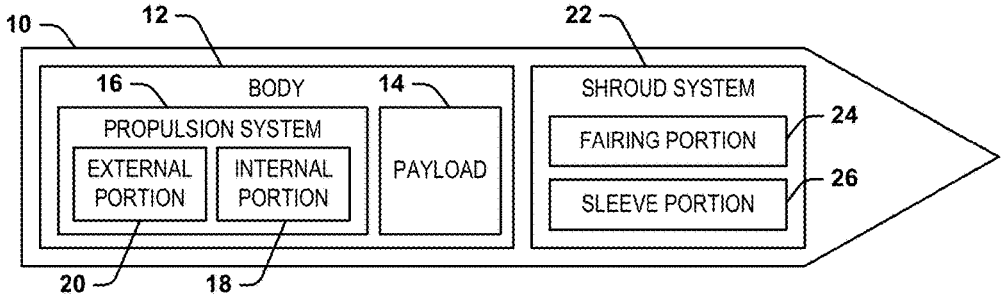
FIG. 1 illustrates an example diagram of an aircraft system.

FIG. 1 illustrates an example diagram of an aircraft system 10. The aircraft system 10 can be configured as a missile or as a rocket that can be implemented in a variety of military, space, or aviation missions. The aircraft system 10 includes a body 12. The body 12 can include a payload 14, such as configured as an explosive payload, and a propulsion system 16 that is configured to enable the aircraft system 10 to launch and to efficiently travel long distances according to a predetermined mission protocol. The propulsion system 16 can include a plurality of propulsion sub-systems that can be sequentially activated at respective launch stages of the mission to allow the aircraft system 10 to achieve a cruising velocity and altitude, thus allowing the aircraft system 10 to complete a mission objective. In the example of FIG. 1, the propulsion system 16 includes an internal portion 18 and an external portion 20, with each of the internal portion 18 and external portion 20 including at least one propulsion sub-system.

The aircraft system 10 also includes a shroud system 22. The shroud system 22 is configured to substantially enclose at least a portion of the body 12, including the payload 14 and the internal portion 18 of the propulsion system 16. Therefore, the internal portion 18, as described herein, is internal to the shroud system 22. The shroud system 22 is configured to substantially protect the respective at least a portion of the body 12 from atmospheric conditions, such as precipitation and dense atmospheric air during launch, such that the shroud system 22 can substantially mitigate damage to the payload 14 and other sensitive components of the aircraft system 10 (e.g., navigation and/or control circuits not shown in the example of FIG. 1). For example, the shroud system 22 can be configured to protect the payload 14 and other sensitive components from damage resulting from weather conditions (e.g., rain, snow, hail), from environmental conditions (e.g., sand), and/or from other airborne objects (e.g., birds). Furthermore, the shroud system 22 can provide additional protection from extremely low temperatures at extremely high altitudes, such as can result in the freezing of liquid fuel or cooling of solid fuel. As described herein, the launch of the aircraft system 10 can include a detach stage during which the aircraft system 10 detaches the shroud system 22 to provide for a more efficient travel (e.g., cruising) of the aircraft system 10, such as at an altitude above detrimental atmospheric conditions.

The shroud system 22 includes a fairing portion 24 and a sleeve portion 26 that are detachably coupled to each other. The fairing portion 24 can be arranged as multiple substantially equal-sized fairing elements that are arranged in approximately equal angles about a cross-section with respect to a longitudinal axis of the aircraft system, such that the fairing portion 24 substantially covers a front end of the aircraft system 10. The sleeve portion 26 can be arranged as a substantially tubular unitary structure that surrounds a portion of the body 12 along a longitudinal axis. As an example, the fairing portion 24 can include a first fairing element and a second fairing element that are arranged equally with respect to the longitudinal axis, such that the first and second fairing elements are arranged in a clamshell configuration. During the detach stage of the launch, the fairing elements of the fairing portion 24 can be released from each other to rotationally pivot about break-away hinges, such that the fairing elements can separate from the sleeve portion 26 in response to rotating greater than a predetermined angle about the respective break-away hinges. Subsequent to the separation of the fairing elements of the fairing portion 24, the portion of the body 12 that is substantially surrounded by the sleeve portion 26 can axially separate from the sleeve portion 26, such as via the internal portion 18 of the propulsion system 16, and thus substantially concurrently with the separation of the external portion 20 of the propulsion system 16. The aerodynamic force on the fairing portion 24 can apply forces on hinges that attach the fairing elements of the fairing portion 24 to the sleeve portion 26, with such forces including significant components in the aft axial direction. The aft axial force components can facilitate an axial aft translation of the sleeve portion 26 relative to the body 12, thus providing additional ease in providing axial separation of body 12 from the sleeve portion 26 of the shroud system 22 during the detach stage. Additionally, the internal portion 18 of the propulsion system 16 can operate to axially eject the remaining portion of the body 12 from the sleeve portion 26 to completely detach the shroud portion 22.

By implementing the shroud system 22 as including the fairing portion 24 and the sleeve portion 26, the shroud system 22 can provide a more efficient shrouding than typical shrouding systems that implement a two-piece shrouding that longitudinally extends along the length of the entire shrouding system, such as separating into the two longitudinal fairing elements during deployment. For example, a full two fairing element enclosure shroud design where the entire shroud is jettisoned can introduce significant structural weight penalties along with aerodynamic shocks during the jettison event. Thus, the shroud system 22 can provide the benefit of full environmental protection and conditioning while minimizing the structural weight due to the use of a continuous tubular structure without seams for the sleeve portion 26. Thus, the separation and jettisoning of the smaller mass fairing elements of the fairing portion relative to the full two fairing element enclosure shroud design can subject the aircraft system 10 to less static and dynamic forces on the remaining structure of the aircraft system 10. Additionally, the aerodynamic shocks during high-speed jettison of the fairing portion 24 can be significantly mitigated relative to a typical full shroud jettison due to both the much smaller duration of time of the aerodynamic blockage of airflow to protruding portions of the aircraft system 10 (e.g., tailfins) and also the distance forward of the flight control surfaces of the propulsion system 16. Additionally, the intensity of aerodynamic disturbances on the downstream portions of the aircraft system 10 can be mitigated due to the fairing portion 26 being much further forward of booster flight control surfaces of the aircraft system 10, relative to a typical full shroud jettison. Thus, less weight of the total shroud system 22 provides greater system flight performance, and the lower aerodynamic shock during the jettison of the fairing portion 24 can provide lower system loads and associated design risk.

Figure 2:
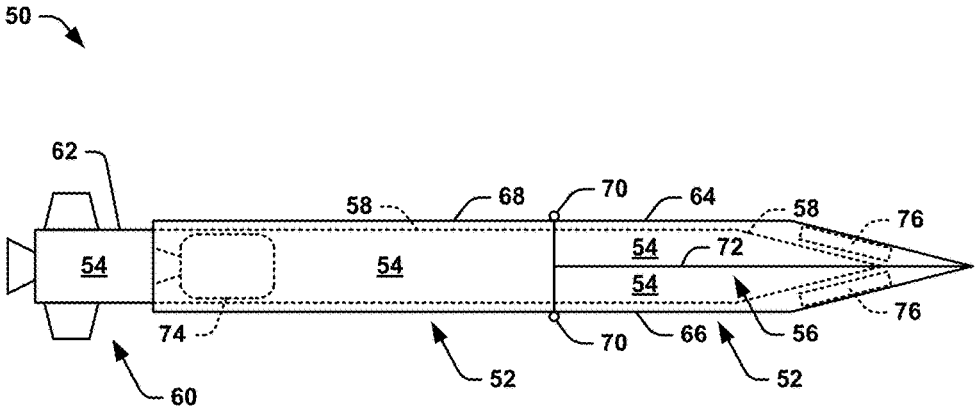
FIG. 2 illustrates another example diagram of an aircraft system.

FIG. 2 illustrates another example diagram of an aircraft system 50. The aircraft 50 can be configured as a missile or as a rocket that can be implemented in a variety of military, space, or aviation missions. As an example, the aircraft 50 can be launched from a VLS canister on-board a naval vessel. In the example of FIG. 2, the aircraft 50 includes a shroud system 52 that covers a portion of a body 54 of the aircraft system 50. In the example of FIG. 2, the shroud system 52 encloses a front portion 56 (e.g., a nose portion) of the body 54 and extends along an axial length of the body 54. The portion of the body 54 that is enclosed by the shroud system 52 corresponds to an internal portion 58. The body 54 also extends from outside of the shroud system 52 toward a rear portion 60 of the aircraft system 50, and is thus not enclosed by the shroud system 52. The portion of the body 54 that is not enclosed by the shroud system 52 corresponds to an external portion 62.

The shroud system 52 includes a first fairing element 64 and a second fairing element 66 that substantially enclose the front portion 56 of the aircraft system 50, and includes a sleeve portion 68 that is detachably coupled to the first and second fairing elements 64 and 66 behind the first and second fairing elements 64 and 66 with respect to an axial length of the aircraft system 50 relative to the front portion 56. The first and second fairing elements 64 and 66 are demonstrated as enclosing a cross-sectional area with respect to the axial length of the aircraft system 50 at an approximately equal dimension as the sleeve portion 68 and tapering to a smaller dimension toward the front portion 56 of the aircraft system 50 to aerodynamically reduce drag. The taper of the front portion 56, and thus the first and second fairing elements 64 and 66, can be to an approximate point or can be a linear taper (e.g., shovel-nose). While the shroud system 52 is described herein as including only two portions, it is to be understood that the fairing portion can include more than two fairing elements, such as substantially equally angularly distributed about the longitudinal axis of the aircraft system 50 to provide substantially equal mass during launch and substantially equal deployment about the longitudinal axis during the detach stage.

In the example of FIG. 2, the first and second fairing elements 64 and 66 are coupled to the sleeve portion 68 via a set of break-away hinges 70 that are configured to allow the first and second fairing elements 64 and 66, during the detach stage of the launch, to rotate away equally from the axial length of the aircraft system 50 and to physically separate from the sleeve portion 68, and thus from the aircraft system 50, in response to rotating a predetermined angle. Therefore, the first and second fairing elements 64 and 66 are demonstrated in a "clamshell" arrangement, such that the first and second fairing elements 64 and 66 can open based on rotation at the break-away hinges 70. For example, the first and second fairing elements 64 and 66 can be coupled at one or more locations at a seam 72 that extends between the first and second fairing elements 64 and 66, such that during the detach stage of the launch, the coupling can be released to allow the first and second fairing elements 64 and 66 to open relative to each other by rotating about the hinges 70 based on air filling the resultant cavity between the body 54 and the first and second fairing elements 64 and 66 as the aircraft system 50 flies forward.

In addition, in the example of FIG. 2, the aircraft system 50 includes an internal propulsion sub-system 74 that is located in the internal portion of the body 54, and thus enclosed by the sleeve portion 68 of the shroud system 52. During the detach stage, at a time approximately concurrent with or immediately subsequent to the decoupling of the first and second fairing elements 64 and 66 with each other, the internal propulsion sub-system 74 can be initiated to propel the aircraft system 50, thus separating the internal portion 58 of the body 54 from the sleeve portion 68 and the external portion 62 of the body 54. As an example, the internal propulsion sub-system 74 can be configured as a booster, such as a solid-fuel kick motor booster as described in U.S. patent application Ser. No. 15/282,184, filed Sep. 30, 2016, entitled: "AIRCRAFT PROPULSION SYSTEM", which is incorporated in its entirety herein by reference. Therefore, the sleeve portion 68 can be axially separated from the internal portion 58 of the body 54, along with the external portion 62 of the body 54 that may remain coupled to the sleeve portion 68, such that the sleeve portion 68 and the external portion 62 of the body 54 can be jettisoned to drop from the aircraft system 50 as the aircraft system 50 is propelled by the internal propulsion sub-system 74.

Furthermore, in the example of FIG. 2, the aircraft system 50 includes one or more liquid fuel tanks 76 that are located beneath and coupled to the shroud system 52. As an example, the liquid fuel tank(s) 76 can be located beneath and coupled to the first and second fairing elements 64 and 66. As an example, the liquid fuel tank(s) 76 can correspond to unpressurized fuel reserves for one or more propulsion sub-systems associated with the external portion 62 of the body 54, such as a ramjet, as described in U.S. patent application Ser. No. 15/282,184, filed Sep. 30, 2016. Therefore, the liquid fuel tank(s) 76 can be arranged in a flexible manner that can distribute mass about the longitudinal axis in a substantially even manner. In addition, as demonstrated in the example of FIG. 2, the liquid fuel tank(s) 76 can be located inside the first and second fairing elements 64 and 66 to place the fuel mass toward the front portion 56 of the aircraft system 50 for improved flight control and aerodynamic performance. Subsequent to the detach stage, the empty liquid fuel tank(s) 76 can be jettisoned from the aircraft system 50 during the transition, and are thus no longer contributing mass to the aircraft system 50 for more efficient cruising of the remaining portion of the aircraft system 50.

Figure 3:
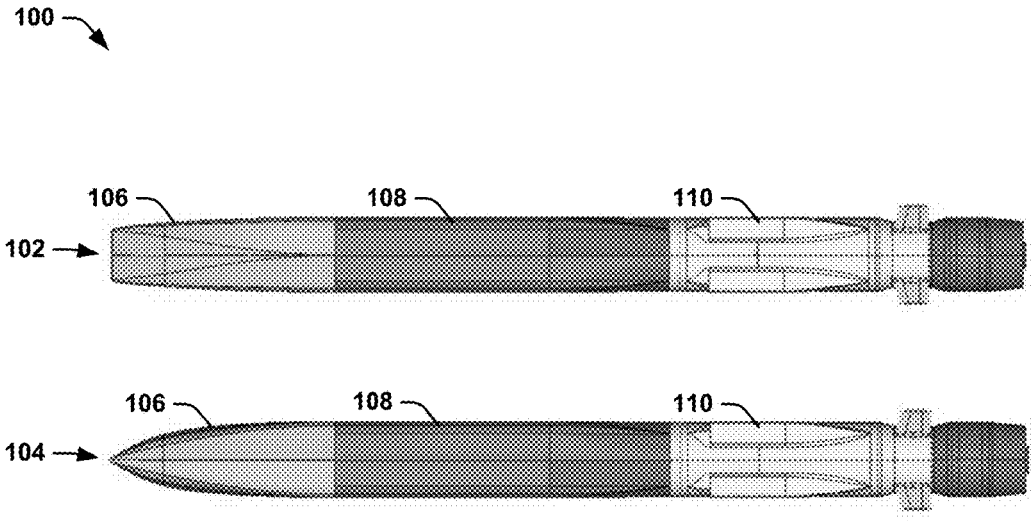
FIG. 3 illustrates an example of an aircraft.

FIG. 3 illustrates an example of an aircraft 100. The aircraft 100 is demonstrated as a missile or as a rocket in a shrouded state, and thus in a pre-launch state, that can be implemented in a variety of military, space, or aviation missions. The aircraft 100 is demonstrated in a top view 102 and a side view 104. The aircraft 100 includes a fairing portion 106 and a sleeve portion 108 that can collectively correspond to a shroud system, similar to the shroud system 52 described previously in the example of FIG. 2. Therefore, the fairing portion 106 and the sleeve portion 108 can collectively surround an internal portion of a body of the aircraft 100, such as including a payload and an internal propulsion sub-system. The aircraft 100 also includes an external body portion 110 that can include one or more external propulsion sub-systems (e.g., an initial launch solid propellant booster and/or a turbofan or ramjet).

Figure 4:
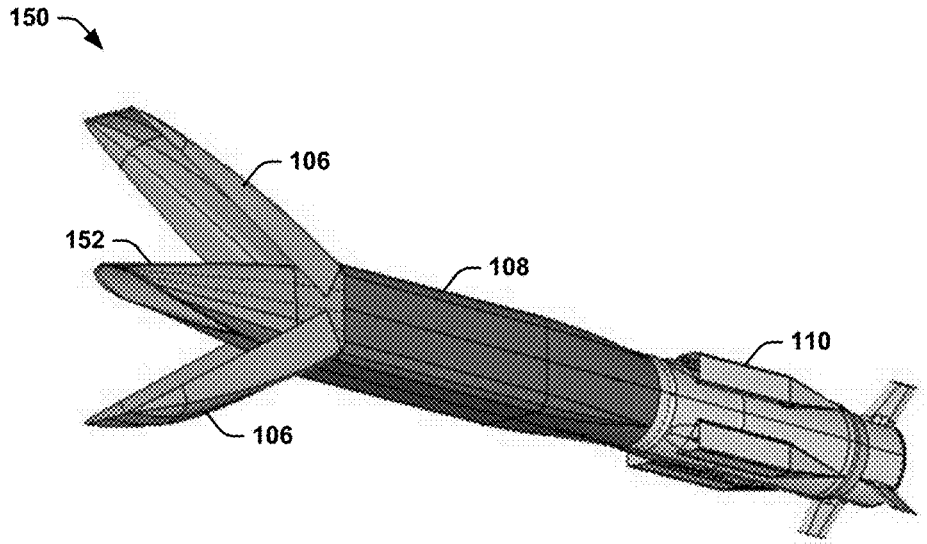
FIG. 4 illustrates an example diagram of a detach stage of a launch of an aircraft.

FIG. 4 illustrates an example diagram 150 of a detach stage of a launch of the aircraft 100. The diagram 150 can demonstrate an initial part of the detach stage of the aircraft 100, and thus in a transition from the shrouded state to the deployed state of the aircraft 100, such as subsequent to the aircraft 100 achieving an altitude that is significantly higher than deleterious weather conditions (e.g., above approximately 40,000 feet). The diagram 150 demonstrates the fairing portion 106 separating into respective first and second fairing elements. The fairing portion 106 is substantially similar to the arrangement of the first and second fairing elements 64 and 66 in the example of FIG. 2, and is thus arranged in a clamshell configuration. Thus, in the initial part of the detach stage, the two halves (e.g., fairing elements) of the fairing portion 106 become decoupled at the interconnecting seam, and the two halves of the fairing portion 106 rotate about break-away hinges (e.g., substantially similar to the break-away hinges 70 in the example of FIG. 2). Upon the two halves of the fairing portion 106 opening, the internal portion of the body can be exposed, demonstrated in the example of FIG. 4 at 152.

Figure 5:
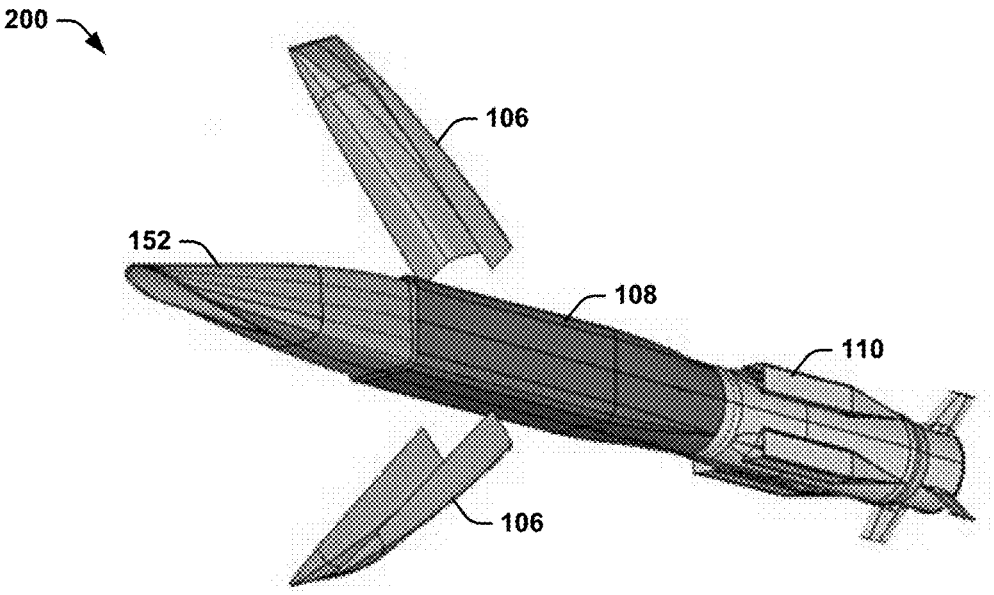
FIG. 5 illustrates another example diagram of a detach stage of a launch of an aircraft.

FIG. 5 illustrates another example diagram 200 of the detach stage of the launch of the aircraft 100. The diagram 200 demonstrates that, in response to the fairing portion 106 rotating greater than a predetermined angle, the fairing portion 106 separates from the sleeve portion 108. As an example, the predetermined angle can be such that, upon separation of the fairing portion 106 from the sleeve portion 108, the fairing portion 106 can be pushed away from the sleeve portion 108, and thus the aircraft 100, based on air flow as the aircraft 100 travels. Thus, the fairing portion 106 can avoid colliding with and damaging the aircraft 100 as the aircraft 100 continues to fly, and the fairing portion 106 can fall through the atmosphere, having been removed from the sleeve portion 108. During the rotation, the fairing elements of the fairing portion 106 apply forces about the hinge on the sleeve portion 108. The hinge forces can include significant forces in the axial aft direction on the sleeve portion 108, which can facilitate the relative separation of the sleeve portion 108 and the external body portion 110 from the body 152. In addition, at approximately the time of separation of the fairing portion 106, an internal propulsion sub-system can be initiated to axially propel the body 152 forward relative to the sleeve portion 108 and the external body portion 110.

Figure 6:
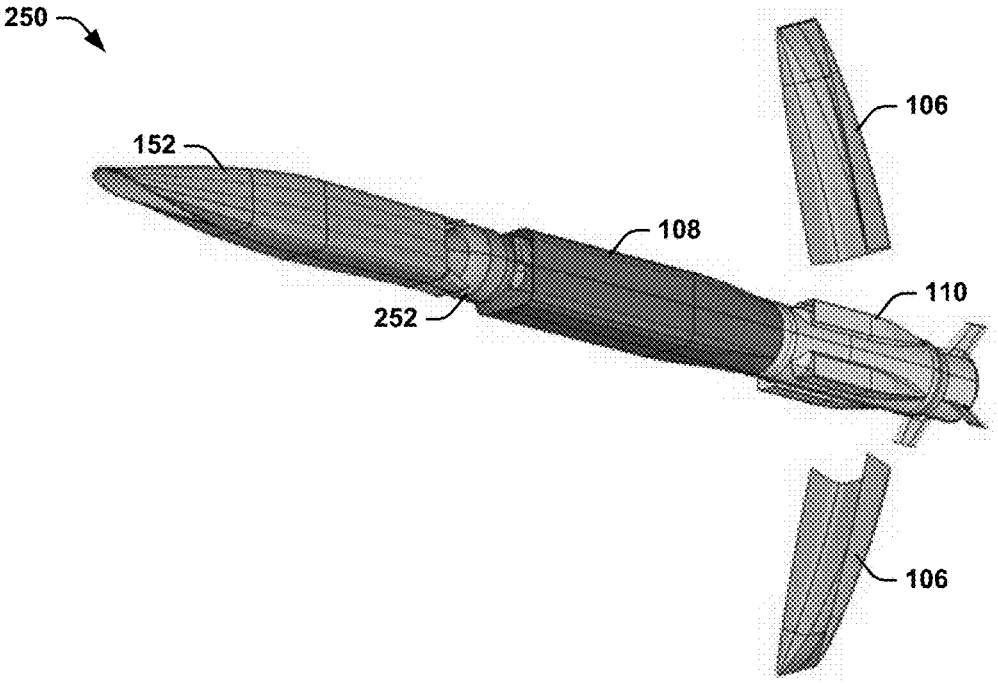
FIG. 6 illustrates yet another example diagram of a detach stage of a launch of an aircraft.

FIG. 6 illustrates yet another example diagram 250 of the detach stage of the launch of the aircraft 100. The diagram 250 demonstrates the fairing portion 106 flying away relative to the aircraft 100 based on the airflow as the aircraft 100 travels. In addition, the diagram 250 demonstrates the internal propulsion sub-system, demonstrated in the example of FIG. 6 at 252, propelling the remaining portions of the aircraft 100 in the deployed state (e.g., the internal body portion 152) forward. Thus, the internal body portion 152 and the internal propulsion sub-system 252 remain coupled together as the internal body portion 152 and the internal propulsion sub-system 252 are decoupled from the sleeve portion 108 and the external body portion 110. Therefore, the internal propulsion sub-system 252 propels the deployed state aircraft 100 axially forward after internal propulsion sub-system 252 and the internal body portion 152 are decoupled from the sleeve portion 108 and the external body portion 110. The sleeve portion 108 and the external body portion 110 can thus drop through the atmosphere, and the remaining portions of the flying aircraft 100 (e.g., the deployed state including the internal body portion 152 and the internal propulsion sub-system 252) can continue cruising toward a mission objective in a more efficient manner.

Figure 7:
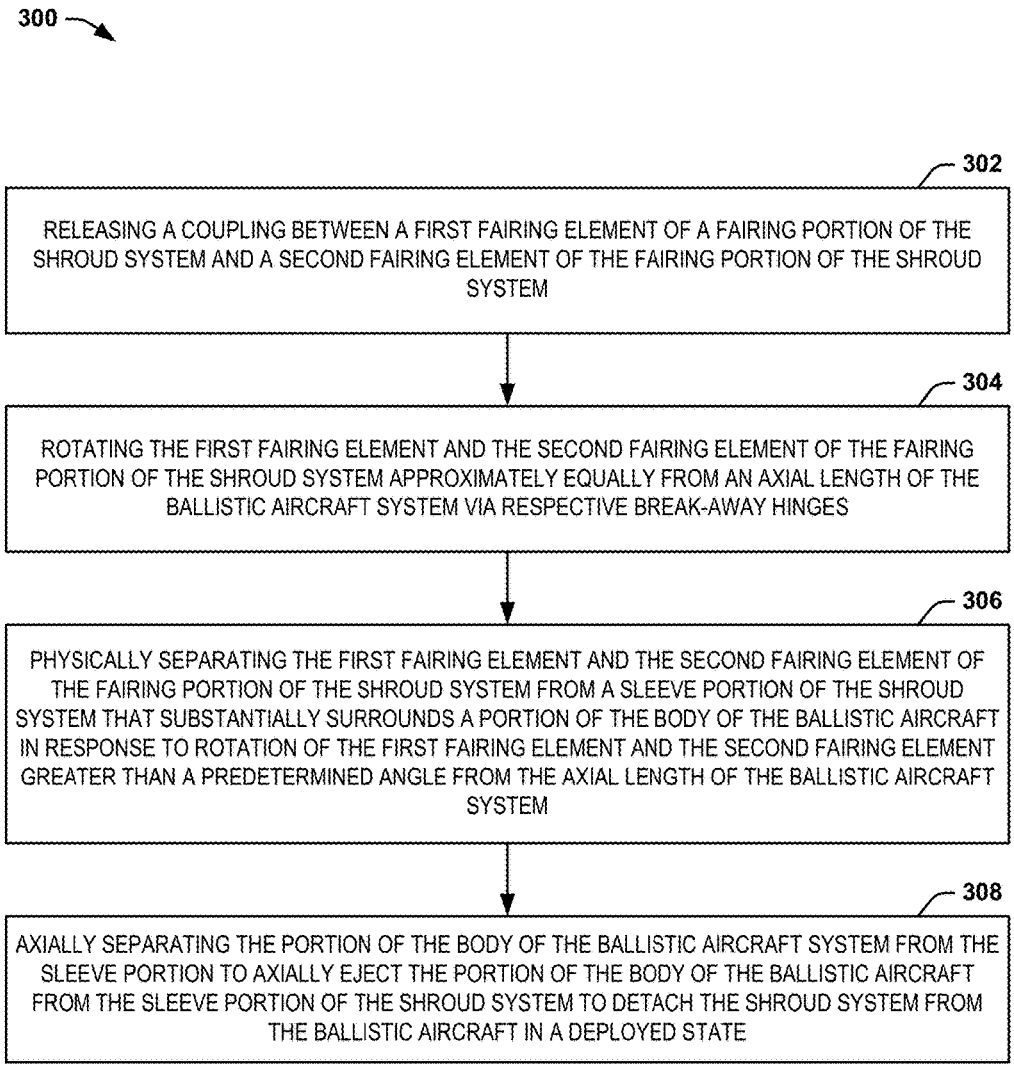
FIG. 7 illustrates an example of a method for detaching a shroud system associated with an aircraft.

In view of the foregoing structural and functional features described above, a methodology in accordance with various aspects of the present disclosure will be better appreciated with reference to FIG. 7. While, for purposes of simplicity of explanation, the methodology of FIG. 7 is shown and described as executing serially, it is to be understood and appreciated that the present disclosure is not limited by the illustrated order, as some aspects could, in accordance with the present disclosure, occur in different orders and/or concurrently with other aspects from that shown and described herein. Moreover, not all illustrated features may be required to implement a methodology in accordance with an aspect of the present disclosure.

FIG. 7 illustrates an example of a method 300 for detaching a shroud system (e.g., the shroud system 22) that substantially encloses at least a portion of a body (e.g., the body 12) of an aircraft system (e.g., the aircraft system 10) in a shrouded state. At 302, a coupling between a first fairing element (e.g., the first fairing element 64) of a fairing portion (e.g., the fairing portion 24) of the shroud system and a second fairing element (e.g., the second fairing element 66) of the fairing portion of the shroud system is released. At 304, the first fairing element and the second fairing element of the fairing portion of the shroud system are rotated approximately equally from an axial length of the aircraft system via respective break-away hinges (e.g., the hinges 70). At 306, the first fairing element and the second fairing element of the fairing portion of the shroud system are separated from a sleeve portion (e.g., the sleeve portion 26) of the shroud system that substantially surrounds a portion of the body of the aircraft in response to rotation of the first fairing element and the second fairing element greater than a predetermined angle from the axial length of the aircraft system. At 308, the portion of the body of the aircraft system is axially separated from the sleeve portion to axially eject the portion of the body of the aircraft from the sleeve portion of the shroud system to detach the shroud system from the aircraft in a deployed state.

What have been described above are examples of the invention. It is, of course, not possible to describe every conceivable combination of components or method for purposes of describing the invention, but one of ordinary skill in the art will recognize that many further combinations and permutations of the invention are possible. Accordingly, the invention is intended to embrace all such alterations, modifications, and variations that fall within the scope of this application, including the appended claims.

What is claimed is:

1. An aircraft system comprising:

a body comprising a payload and a propulsion system, the propulsion system being configured to enable launch and flight of the aircraft system; and a shrouding system that substantially encloses at least a portion of the body in a shrouded state, the shrouding system comprising a fairing portion and a sleeve portion that are arranged as detachably coupled with respect to each other and with respect to the at least a portion of the body, wherein the sleeve portion comprises a tubular unitary structure portion that substantially surrounds the at least a portion of the body along a longitudinal axis of the aircraft system, wherein the fairing portion separates from the sleeve portion in a deployed state and wherein the body becomes axially separated from the sleeve portion in the deployed state, the aircraft system switching from the shrouded state to the deployed state during a detach stage of the launch of the aircraft system.

2. The system of claim 1, wherein the fairing portion comprises a plurality of substantially equal sized fairing elements that are arranged in approximately equal angles about a cross-section with respect to a longitudinal axis of the aircraft system.

3. The system of claim 1, wherein the fairing portion comprises a first fairing element and a second fairing element that substantially enclose a front portion of the body, wherein the first portion and the second portion are separated from the sleeve portion substantially concurrently during the detach stage opposite each other with respect to a longitudinal axis of the aircraft system.

4. The system of claim 3, wherein the first fairing element and the second fairing element of the fairing portion are arranged in a clamshell configuration in the shrouded state.

5. The system of claim 3, wherein the first fairing element and the second fairing element of the fairing portion are coupled to the sleeve portion via break-away hinges, such that the first portion and the second portion are configured to rotationally swivel about the respective break-away hinges during the detach stage of the launch before separating from the sleeve portion in response to an angle of the rotational swivel of the respective first and second fairing elements exceeding a predetermined angle.

6. The system of claim 1, wherein the sleeve portion comprises a maximum cross-sectional dimension with respect to a longitudinal axis of the aircraft system, wherein the fairing portion comprises a cross-sectional dimension with respect to the longitudinal axis of the aircraft system that decreases from the maximum cross-sectional dimension of the sleeve portion at a coupling of the sleeve portion and the fairing portion and which decreases in a tapered manner toward a front end of the aircraft system.

7. The system of claim 1, wherein at least a portion of the shrouding system is configured to store liquid fuel associated with the propulsion system.

8. The system of claim 7, wherein the fairing portion of the shrouding system is configured to store the liquid fuel associated with the propulsion system to provide balance mass distribution for the aircraft system.

9. The system of claim 1, wherein the propulsion system comprises:

an external portion that is coupled to and exterior with respect to the sleeve portion, the external portion being configured to provide thrust during an initial at least one stage of the launch and flight; and an internal portion that is substantially enclosed by the sleeve portion, the internal portion being configured to provide thrust during the detach stage of the launch to axially detach the body from the sleeve portion subsequent to the separation of the fairing portion from the sleeve portion.

10. A method for detaching a shroud system that substantially encloses at least a portion of a body of an aircraft system in a shrouded state, the method comprising:

releasing a coupling between a first fairing element of a fairing portion of the shroud system and a second fairing element of the fairing portion of the shroud system;

rotating the first fairing element and the second fairing element of the fairing portion of the shroud system approximately equally from an axial length of the aircraft system via respective break-away hinges;

physically separating the first fairing element and the second fairing element of the fairing portion of the shroud system from a sleeve portion of the shroud system that substantially surrounds a portion of the body of the aircraft in response to rotation of the first fairing element and the second fairing element greater than a predetermined angle from the axial length of the aircraft system; and axially separating the portion of the body of the aircraft system from the sleeve portion to axially eject the portion of the body of the aircraft from the sleeve portion of the shroud system to detach the shroud system from the aircraft in a deployed state.

11. The method of claim 10, wherein releasing the coupling comprises releasing the coupling between a plurality of substantially equal sized fairing elements that are arranged in approximately equal angles about a cross-section with respect to a longitudinal axis of the aircraft system.

12. The method of claim 10, wherein releasing the coupling comprises releasing the coupling between the first and second fairing elements of the fairing portion arranged in a clamshell arrangement.

13. The method of claim 10, wherein at least a portion of the shrouding system is configured to store liquid fuel associated with a propulsion system associated with the aircraft system.

14. The method of claim 10, wherein axially separating the portion of the body of the aircraft system from the sleeve portion comprises axially separating the portion of the body of the aircraft system from the sleeve portion via a propulsion system associated with the aircraft system.

15. The method of claim 10, wherein the sleeve portion comprises a tubular portion that substantially surrounds the at least a portion of the body along a longitudinal axis of the aircraft system.

16. An aircraft system comprising:

a body comprising a payload and a propulsion system, the propulsion system being configured to enable launch of the aircraft system; and a shrouding system that substantially encloses at least a portion of the body in a shrouded state, the shrouding system comprising:

a fairing portion comprising a plurality of substantially equal sized fairing elements that are arranged in approximately equal angles about a cross-section with respect to a longitudinal axis of the aircraft system and which are configured to separate and detach from the shrouding system in a deployed state during a detach stage of the launch of the aircraft system; and a sleeve portion comprising a tubular unitary portion that substantially surrounds the at least a portion of the body along a longitudinal axis of the aircraft system, the sleeve portion being arranged as detachably coupled with respect to the fairing portion and with respect to the at least a portion of the body, wherein the body becomes axially separated from the sleeve portion in the deployed state via the propulsion system during the detach stage of the launch of the aircraft system.

17. The system of claim 16, wherein the plurality of fairing elements are coupled to the sleeve portion via break-away hinges, such that the plurality of fairing elements are configured to rotationally swivel about the respective break-away hinges during the detach stage of the launch before separating from the sleeve portion in response to an angle of the rotational swivel of the respective first and second fairing elements exceeding a predetermined angle.

18. The system of claim 16, wherein at least a portion of the shrouding system is configured to store liquid fuel associated with the propulsion system to provide balance mass of the aircraft system.

19. The system of claim 16, wherein the propulsion system comprises:

an external portion that is coupled to and exterior with respect to the sleeve portion, the external portion being configured to provide thrust during an initial at least one stage of the launch; and an internal portion that is substantially enclosed by the sleeve portion, the internal portion being configured to provide thrust during the detach stage of the launch to axially detach the body from the sleeve portion subsequent to the separation of the fairing portion from the sleeve portion.

* * * * *